US009651057B2

(12) United States Patent
Lyons

(10) Patent No.: US 9,651,057 B2
(45) Date of Patent: May 16, 2017

(54) BLOWER ASSEMBLY INCLUDING A NOISE ATTENUATING IMPELLER AND METHOD FOR ASSEMBLING THE SAME

(71) Applicant: Regal Beloit America, Inc., Beloit, WI (US)

(72) Inventor: Leslie Alan Lyons, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 495 days.

(21) Appl. No.: 14/134,673

(22) Filed: Dec. 19, 2013

(65) Prior Publication Data

US 2015/0176586 A1 Jun. 25, 2015

(51) Int. Cl.

*F04D 17/10* (2006.01)
*F04D 29/30* (2006.01)
*F04D 29/28* (2006.01)

(52) U.S. Cl.

CPC ..... *F04D 29/30* (2013.01); *F04D 29/282* (2013.01); *F05D 2240/304* (2013.01); *Y10T 29/49327* (2015.01)

(58) Field of Classification Search

CPC ..... F04D 29/282; F04D 29/30
USPC ..... 416/179, 182, 185, 186 R, 187, 188
See application file for complete search history.

(56) References Cited

U.S. PATENT DOCUMENTS 3,403,893 A 10/1968 Stoffer
5,588,803 A 12/1996 Vetter et al.
5,895,206 A 4/1999 Chuang et al.
5,964,576 A * 10/1999 Fujita ..... F04D 29/282 415/206
6,095,752 A 8/2000 Gronier et al.
6,537,030 B1 3/2003 Garrison
9,004,868 B2 * 4/2015 Rhodes ..... F04D 29/281 29/889.4
9,011,090 B2 * 4/2015 Huang ..... F04D 25/0613 415/206
2009/0047133 A1 2/2009 Nishino
2009/0290986 A1 11/2009 Haraguchi
2011/0033306 A1 * 2/2011 Teraoka ..... F04D 17/06 416/223 R
2011/0286848 A1 * 11/2011 Rhodes ..... F04D 29/281 416/185
2012/0201669 A1 8/2012 Mallaiah et al.

OTHER PUBLICATIONS

International Search Report and Written Opinion issued in PCT/US2014/69914, mailed Apr. 12, 2015.

* cited by examiner

*Primary Examiner* — Woody Lee, Jr.
(74) *Attorney, Agent, or Firm* — Armstrong Teasdale LLP

(57) ABSTRACT

A blower assembly includes a housing including an outlet and a cutoff point positioned proximate the outlet. The blower assembly also includes an impeller including a plurality of blades that each includes a tip portion including a radially outer edge and a transition point that divides the radially outer edge into a first portion and a second portion. The impeller is positioned within the housing such that a first radial gap is defined between the cutoff point and the first portion and a second radial gap is defined between the cutoff point and the second portion. The first radial gap includes a constant width that is shorter than a width of the second radial gap.

19 Claims, 6 Drawing Sheets

BLOWER ASSEMBLY INCLUDING A NOISE ATTENUATING IMPELLER AND METHOD FOR ASSEMBLING THE SAME

BACKGROUND

The field of the disclosure relates generally to blower assemblies, and more specifically, to blower assemblies that include an impeller for attenuating blade pass tones.

Blowers and impellers are commonly used for creating a flow of either a gas or a liquid. More specifically, blowers and impellers may be used in the automotive and air handling and ventilation industries for directing large volumes of forced air, over a wide range of pressures, through a variety of air conditioning components. At least some known impellers use one or a combination of four basic blade designs: radial, forward curved, backward inclined, and backward curved. At least some forward curved impellers include a large number of blades that generally curve in the direction of a wheel hub's rotation, and backward curved impellers have blades that curve against the direction of the wheel hub's rotation. Generally, radial bladed impellers may have fewer blades than forward curved and backward curved designs, and are less efficient than forward curved, backward inclined, and backward curved designs. In addition, backward curved impellers are generally more efficient than forward curved impellers, backward inclined impellers, and radial bladed impellers.

In a known blower assembly, air is drawn into a housing through one or more inlet openings by the impeller. This air is then forced around the housing and out an outlet end. At least some known centrifugal blowers include a cutoff point at the transition between the arcuate blower housing and the outlet end. Blower assembly performance increases as the clearance between the backward curved impeller blade tips and the cutoff point decreases. However, when blade tips pass within close proximity to the cutoff point, they generate air pressure pulses that produce undesirable tonal noises known as blade pass pure tones, any amount of which may be objectionable to a user. Furthermore, the blade edges may generate additional pressure pulses as they pass nearby the edge of the housing inlet. These pressure pulses may also cause undesirable tonal noise.

BRIEF DESCRIPTION

In one aspect, a blower assembly is provided. The blower assembly includes a housing including an outlet and a cutoff point positioned proximate the outlet. The blower assembly also includes an impeller including a plurality of blades that each includes a tip portion including a radially outer edge and a transition point that divides the radially outer edge into a first portion and a second portion. The impeller is positioned within the housing such that a first radial gap is defined between the cutoff point and the first portion and a second radial gap is defined between the cutoff point and the second portion. The first radial gap includes a constant width that is shorter than a width of the second radial gap.

In another aspect, an impeller for use with a blower assembly that includes a cutoff point is provided. The impeller includes a plurality of blades that each include a tip portion having a radially inner edge and an opposing radially outer edge. The radially outer edge includes a transition point that divides the radially outer edge into a first portion and a second portion, wherein the first portion includes a shape that is complementary to a shape of at least a portion of the cutoff point. Each tip portion also includes a first edge face including a first length defined between the radially inner edge and the first portion. Furthermore, each tip portion includes a second edge face including a second length defined between the radially inner edge and the second portion, wherein the first length is longer than the second length.

In yet another aspect, a method of assembling a blower assembly is provided. The method includes providing a housing including an outlet and a cutoff point positioned proximate the outlet. An impeller is then coupled within the housing. The impeller includes a plurality of blades that each include a tip portion including a radially outer edge and a transition point that divides the radially outer edge into a first portion and a second portion. A first radial gap having a constant width is formed between the cutoff point and the first portion, and a second radial gap is formed between the cutoff point and the second portion. The second radial gap includes a width that is longer than the constant width of the first radial gap.

DETAILED DESCRIPTION

Figure 1:
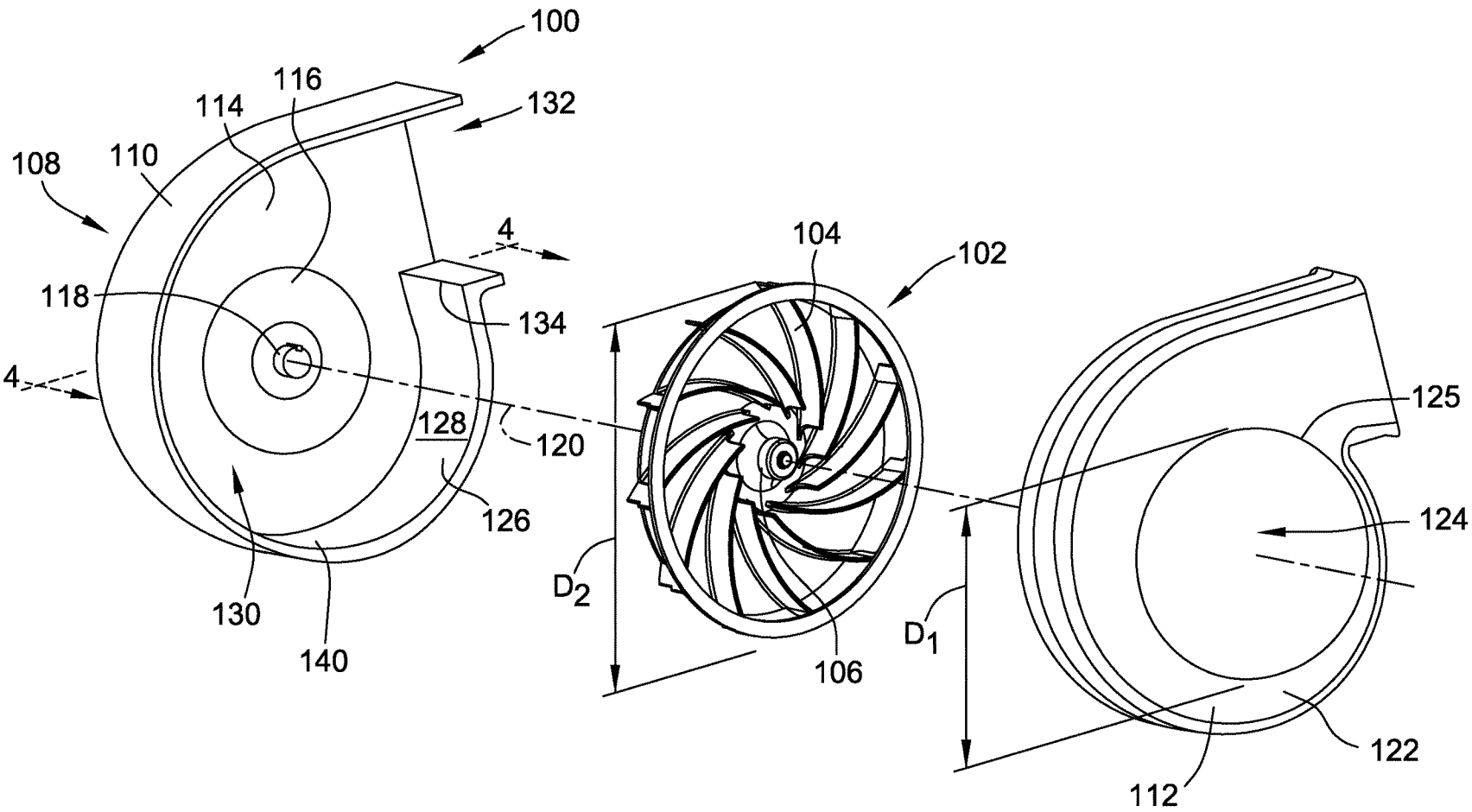
FIG. 1 is an exploded perspective view of an exemplary blower assembly.

FIG. 1 illustrates an exemplary embodiment of a centrifugal blower assembly 100. In the exemplary embodiment, blower assembly 100 is configured to produce a flow of air for a forced air system, e.g., a residential HVAC system. Blower assembly 100 includes at least one impeller 102 that includes a plurality of blades 104 positioned circumferentially about an impeller hub 106. In some known centrifugal blowers, blade shapes include one of a backward curved blade, an airfoil blade, a backward inclined blade, a forward curved blade, and a radial blade. In the exemplary embodiment, impeller blades 104 are backward curved blades. Alternatively, impeller 102 may have any suitable blade shape, for example radial blades, that enables blower assembly 100 to operate as described herein.

Blower assembly 100 further includes a housing 108 comprising a rear portion 110 and a front portion 112. Rear portion 110 includes a first sidewall 114 through which a motor 116 is inserted. Motor 116 includes a shaft 118 that engages hub 106 to facilitate rotation of impeller 102 about an axis 120. Front portion 112 of housing 108 includes a second sidewall 122 having an inlet 124 through which a volume of air is drawn by impeller 102 to provide air to blower assembly 100. Inlet 124 is defined by edge 125 and includes a first diameter $D_1$ that is smaller than a second diameter $D_2$ of impeller 102. Moreover, blower assembly 100 includes a scroll wall 126 having an interior surface 128, wherein scroll wall 126 defines a blower circumference and is positioned between first sidewall 114 and second sidewall 122. As such, scroll wall 126, first sidewall 114, and second sidewall 122 together define a blower chamber 130 and an outlet 132 through which an air stream is exhausted downstream of blower assembly 100.

Scroll wall 126 extends circumferentially from a cutoff point 134 about housing chamber 130 to outlet 132. Cutoff point 134 is the point on blower housing 108 adjacent outlet 132 at which the tips of impeller blades 104 are at their closest point to housing 108, and more specifically, to scroll wall 126, during operation of blower assembly 100. In the exemplary embodiment, impeller 102 is concentric to scroll wall 126 such that a constant radius (not shown) is defined between scroll wall 126 and axis 120. Scroll wall 126 extends circumferentially about impeller 102 until scroll wall 126 reaches cutoff point 134 adjacent outlet 132. Alternatively, scroll wall 126 may diverge away from the tips of blades 104 at cutoff point 134 such that a radius (not shown) between axis 120 and cutoff point 134 is the shortest radius between axis 120 and any other portion of housing 108.

In the exemplary embodiment, when blower assembly 100 is in operation, air enters through air inlet 124 and is deflected radially outward from central axis 120 by blades 104. Blades 104 are configured to draw the air through inlet 124 into blower chamber. The air passes through channels defined between blades 104 and is forced outwards into chamber 130, due to the centrifugal force generated by rotating blades 104, before being exhausted from blower assembly through outlet 132. Although blower assembly 100 is illustrated as having only one inlet 124, outlet 132, and impeller 102, blower assembly 100 may include any number of inlets, outlets, and impellers.

Figure 2:
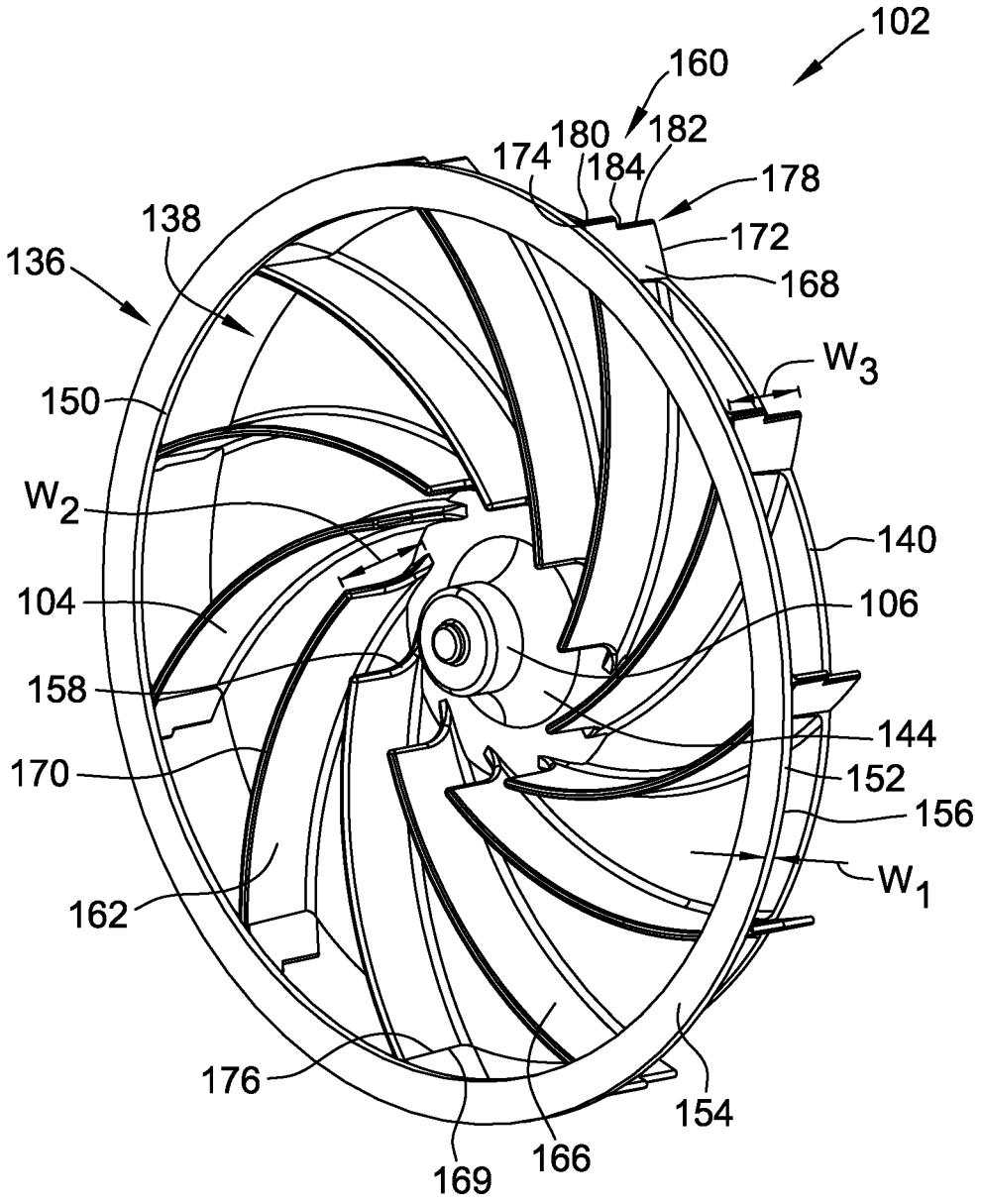
FIG. 2 is a front perspective view of an exemplary impeller that may be used in the blower assembly shown in FIG. 1.
Figure 3:
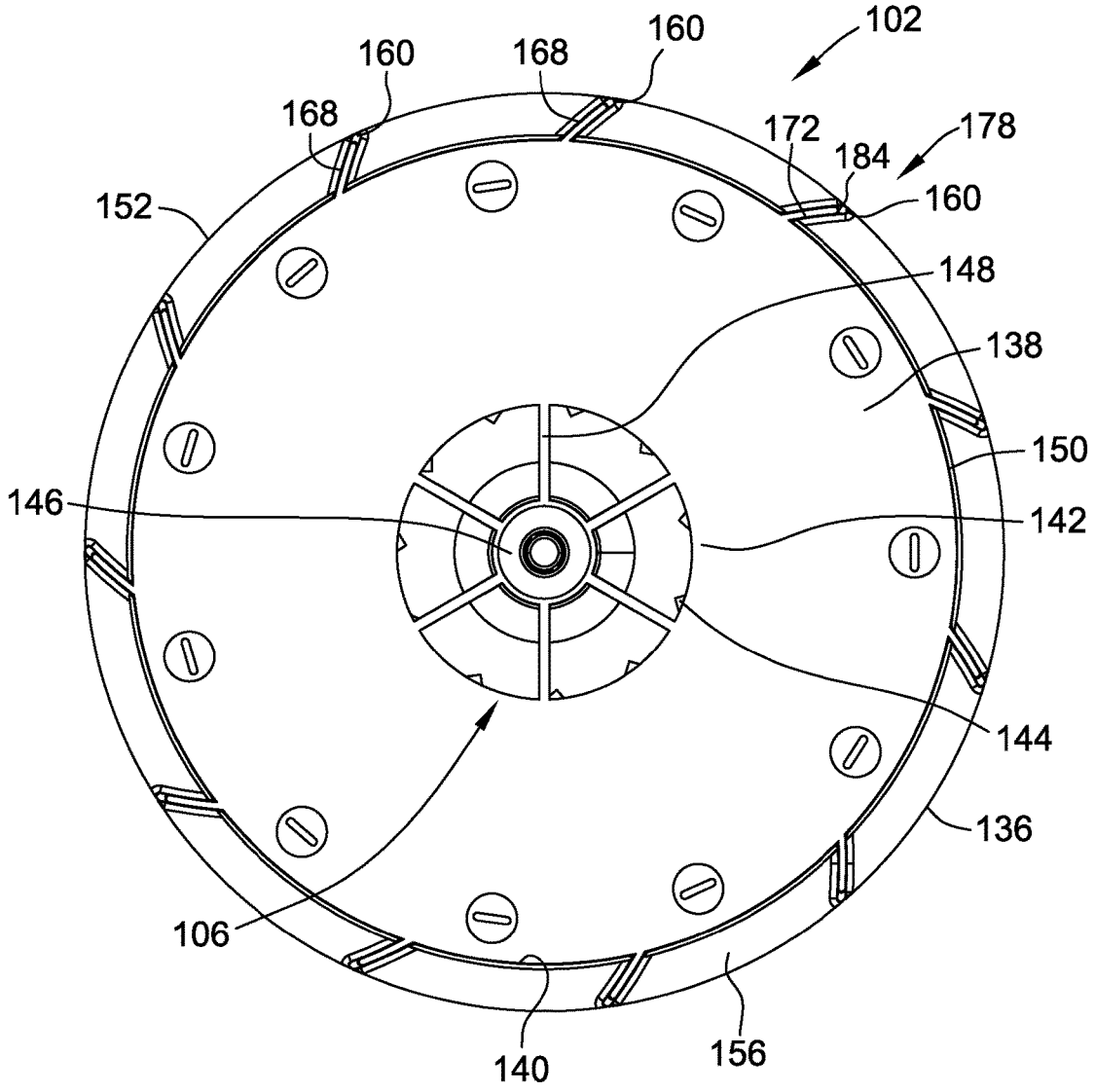
FIG. 3 is a rear view of the impeller shown in FIG. 2.

FIGS. 2 and 3 are front perspective and rear views, respectively, of impeller 102 used in blower assembly 100 shown in FIG. 1. In the exemplary embodiment, impeller 102 is a one-piece component that includes centrally located hub 106, the plurality of individual backward curved impeller blades 104, an inlet support ring 136, and a rear plate 138 that are each integrally connected and formed as a single, molded item. Alternatively, impeller 102 may be a multi-piece component wherein hub 106, blades 104, support ring 136, and rear plate 138 are coupled in any manner that facilitates operation of blower assembly 100 as described herein.

Referring to FIG. 3, rear plate 138 has a substantially circular shape and is substantially flat. Rear plate 138 extends between an outer edge surface 140 and an inner edge surface 142, shown in FIG. 3. Inner edge surface 142 of rear plate 138 mates with an outer hub wall 144 of hub 106. Hub 106 includes an inner hub 146 that is adapted to be fitted onto shaft 118 to transfer rotating motion to impeller 102. Inner hub 146 may be supported by a series of radially extending support ribs 148 that extend upward and mate with the outer surface of hub 106 to provide additional strength for hub 106.

In the exemplary embodiment, support ring 136 of impeller 102 is integrally formed with each impeller blade 104 to provide enhanced stability for blades 104. Support ring 136 is an annular member defined by an inner circumferential surface 150 and an outer circumferential surface 152. Inner edge surface 150 of support ring 136 includes a diameter that is slightly greater than outer edge surface 140 of rear plate 138 for molding purposes. Support ring 136 also includes a ring width $W_1$ defined between a front face surface 154 and a rear face surface 156.

Impeller 102 includes a plurality of backward curved impeller blades 104 that each extend from an inner, leading edge 158 to an outer, trailing edge 160. Each impeller blade 104 includes a constant thickness that is defined by a pair of sidewalls 162 that are substantially perpendicular to rear plate 138 of impeller 102. The perpendicular relationship between impeller blades 104 and rear plate 138 facilitates injection molding impeller 102 without intricate side actions or expensive secondary operations. Each impeller blade 104 further includes a rear edge 164 (shown in FIG. 4) that mates with and is integrally formed with rear plate 138. The interaction between rear edge 164 and rear plate 138 provides further rigidity for each of impeller blades 104.

In the exemplary embodiment, each impeller blade 104 also includes a body portion 166 and a tip portion 168. Body portion 166 extends between leading edge 158 and a radially outer end 169 that is substantially aligned with inner circumferential surface 150 of support ring 136. Body portion 166 includes a body width $W_2$ defined between rear plate 138 and a front edge 170. As illustrated in FIG. 1, front edge 170 of blade body portion 166 is generally coplanar with rear surface 156 of support ring 136. Tip portion 168 extends beyond circular outer edge 140 of rear plate 138 and includes a rear edge surface 172 and a front edge surface 174 that define a tip width $W_3$ therebetween. Tip portion 168 also includes a radially inner end 176 that is adjacent radially outer end 169 of body portion 166. Radially inner end 176 is substantially aligned with inner circumferential surface 150 of support ring 136.

Rear face surface 156 of support ring 136 is integrally formed with tip portion 168 of each impeller blade 104. More specifically, rear face 156 of support ring 136 is integrally connected to each tip portion 168 along front edge surface 174, and rear surface 172 is substantially coplanar with a rear surface of rear plate 138. In the exemplary embodiment, support ring 136 provides for additional support for each impeller blade 104, which allows impeller 102 to be molded as a single, unitary structure. Alternatively, blades 104, support ring 136, and rear plate 138 may be coupled together to form a non-unitary impeller.

Tip portion 168 includes a transition point 178 that divides trailing edge 160 into a first portion 180 and a second portion 182. First portion 180 is positioned proximate support ring 136 and is substantially coplanar with outer circumferential surface 152. Second portion 182 of trailing edge 160 is positioned proximate rear plate 138 and is radially inward of first portion 180. In the exemplary embodiment, first portion 180 and second portion 182 are substantially parallel to each other such that second portion 182 of trailing edge 160 includes a step or notch 184. Alternatively, second portion 182 may include a linearly slanted trailing edge or an arcuate trailing edge, as described in further detail below. In the exemplary embodiment, notch 184 extends from rear edge surface 172 to approximately mid-way along width W3 of trailing edge 160. Alternatively, notch 184 may extend any distance across trailing edge 160. Generally, the size of notch 184 may be optimized to meet any desired performance requirements.

Although impeller 102 as described herein is described as a single-piece open inlet impeller, in other embodiments, impeller 102 may be a two-piece impeller (not shown). The two-piece impeller includes a full rear plate whose outer edge surface is substantially aligned with outer circumferential surface 156 of support ring 136. In such an embodiment, the impeller may also include a front plate sonic welded to front edges 170 of blade body portions 166. Such an impeller may include a tip portion that includes a notch defined on first portion 180 of trailing edge 160 rather than on second portion 182, as described above.

Figure 4:
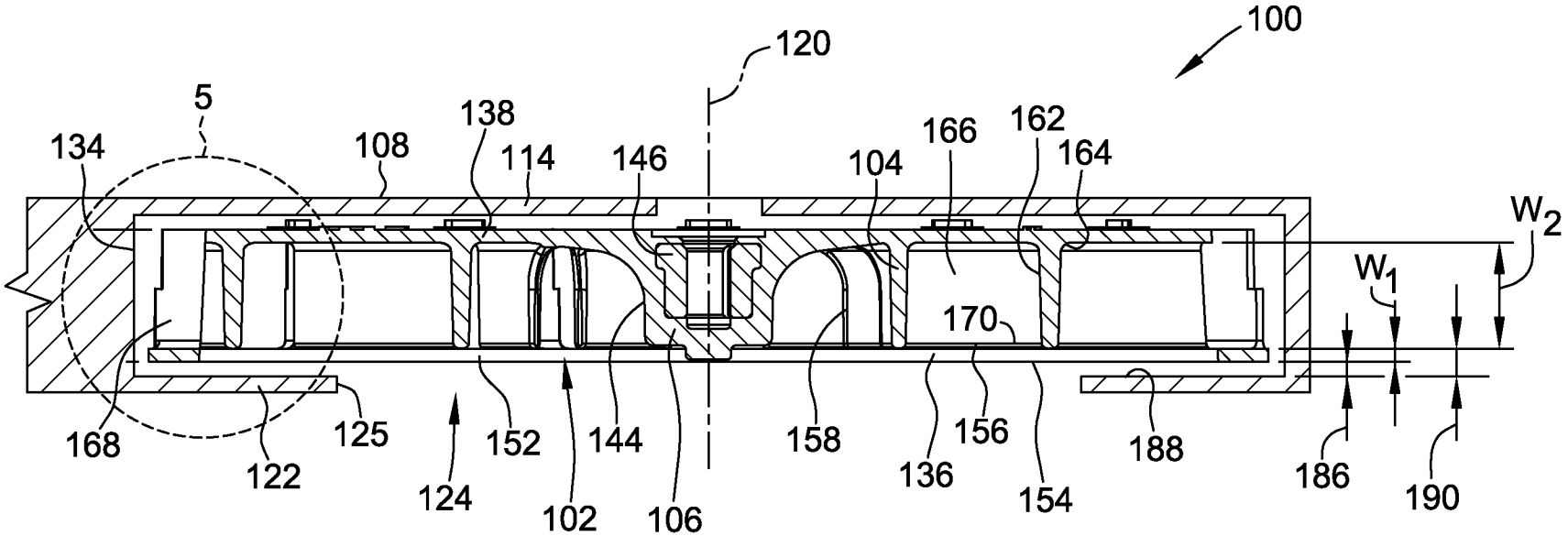
FIG. 4 is a section view taken along line 4-4 of FIG. 1 showing an exemplary modified impeller blade tip.
Figure 5:
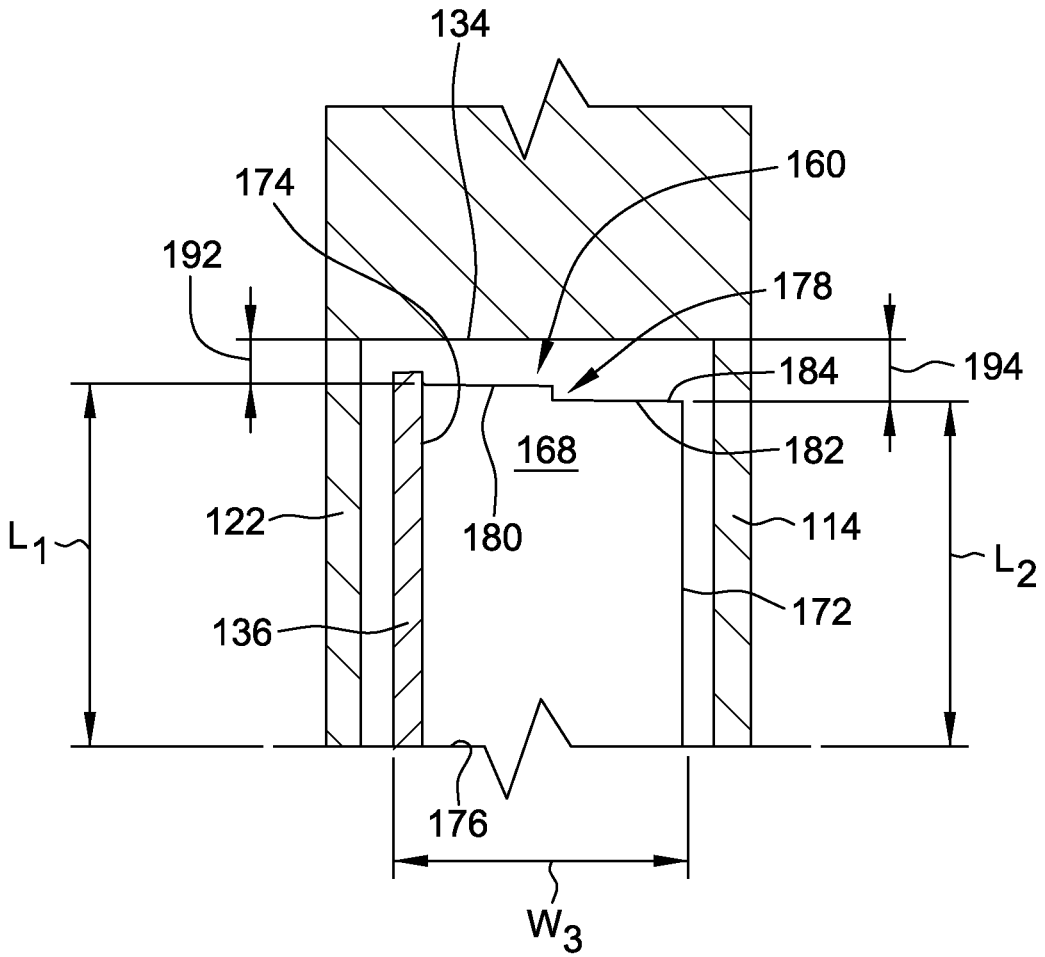
FIG. 5 is an enlarged view of tip portion 168 within line 5-5 shown in FIG. 4.

FIG. 4 is a cross-sectional view of blower assembly 100 taken along line 4-4 shown in FIG. 1. FIG. 5 is an enlarged view of tip portion 168 and cutoff point 134 within line 5-5 shown in FIG. 4. As illustrated in FIG. 4, blower assembly 100 includes impeller 102 positioned within housing 108. In the exemplary embodiment, impeller 102 is positioned substantially mid-way between first sidewall 114 and second sidewall 122 of housing 108 such that support ring 136 is proximate second sidewall 122 and inlet 124. Alternatively, impeller 102 may be positioned at any point between sidewalls 114 and 122 that facilitates operation of blower assembly 100 as described herein. More specifically, in the exemplary embodiment, impeller 102 is positioned such that a first axial gap 186 is defined between front face surface 154 of support ring 136 and an inner surface 188 of second sidewall 122. Furthermore, impeller 102 is positioned such that a second axial gap 190 is defined between front edge surface 170 of blade body portion 166 and inner surface 188 of second sidewall 122, wherein second axial gap 190 is larger than first axial gap 186. In the exemplary embodiment, because front edge surface 170 is coplanar with rear face surface 156 of support ring 136, the difference between axial gaps 186 and 190 is width $W_1$ of support ring 136.

During operation of blower assembly 100, the rotation of impeller 102 about axis 120 rotates blades 104, which drawn in air through inlet 124. In at least some known blower assemblies, the front edge surface of a blade is generally coplanar with a front face surface of the support ring, and the front edge surface is spaced a distance equal to first axial gap 186 from the inner surface of a second sidewall. In such a configuration, the front edge surfaces of each blade generate pressure pulses as they pass nearby the inlet edge. These pressure pulses create undesirable tonal noises, which may be undesirable to a user.

In the exemplary embodiment, width $W_2$ of blade body portion 188 is narrowed by an amount equal to width $W_1$ of support ring 136 such that front edge surface 170 is spaced a distance equal to second axial gap 190 away from inner surface 188 of second sidewall 122. Reducing width W2 of blade body portions 166 such that front edge surface 170 is coplanar with rear face surface 156 of support ring and not front face surface 154 positions blades 104 further away from inlet edge 125 and second sidewall 122. In such a configuration, the pressure pulses generated by blades 104 is reduced, as well as the amount of undesirable tonal noise.

FIG. 5 is an enlarged view of tip portion 168 as it passes in close proximity to cutoff point 134 as identified by line 5-5 shown in FIG. 4. As described above, tip portion 168 is defined on all sides by radially inner end 176, front edge surface 174, trailing edge 160, and rear edge surface 172. Tip portion 168 also includes transition point 178 that divides trailing edge 160 into first portion 180 positioned proximate to support ring 136, and second portion 182 positioned proximate rear plate 138. Front edge surface 174 includes a length $L_1$ defined between radially inner end 176 and first portion 180. Radially inner end 176 and second portion 182, define a length $L_2$ of rear edge surface 172 that is shorter than length $L_1$. Such a configuration defines a first radial gap 192 between cutoff point 134 and first portion 180 of trailing edge 160 and defines a second radial gap 194 between cutoff point 134 and second portion 182 of trailing edge 160. In the exemplary embodiment, first portion 180 has a shape that is complementary to at least portion of cutoff point 134 such that first radial gap defined therebetween includes a constant width. For example, first portion 180 and cutoff point 134 may both be parallel with axis 120 (shown in FIGS. 1 and 4) to define first radial gap 192 having a constant width. Alternatively, first portion 180 and cutoff point 134 may both include complimentary curves or linear slopes that define first radial gap 192 having a constant width therebetween. In the exemplary embodiment, first portion 180 and second portion 182 are substantially parallel to each other and to cutoff point 134 such that the difference between first radial gap 192 and second radial gap 194 is notch 184. For example, in the exemplary embodiment, first radial gap 192 has a constant width of between 0.125 inches (in.) and 0.5 in., while second radial gap 194 includes a width of between 0.25 in. and 0.75 in. Alternatively, gap width depends on a size of blower assembly 100 and first and second radial gaps 192 and 194 may be any size that facilitates operation of blower assembly 100 as described herein.

In the exemplary embodiment, tip portion 168 includes a non-linear trailing edge 160 that maintains blower assembly performance, while also reducing blade pass tones. More specifically, notch 184 facilitates positioning second portion 182 of trailing edge 160 further away from cutoff point 134 than first portion 180 as blades 104 pass by cutoff point 134. The larger second radial gap 194 between notch 184 and cutoff point 134 facilitates reducing pressure pulses caused by trailing edge 160 of tip portion 168 passing in close proximity by cutoff point 134. First portion 180 of trailing edge 160 is spaced from cutoff point 134 by smaller radial gap 192 to facilitate maintaining a majority of blower assembly 100 performance specifications. Notch 184 configures trailing edge 160 to reduce undesirable noise due to second portion 182 being spaced by second radial gap 194 from cutoff point 134. As well, notch 194 configures trailing edge 160 to maintain blower assembly 100 performance since first portion 180 is spaced from cutoff point 134 by first radial gap 192, which is smaller than second radial gap 194.

Figure 6:
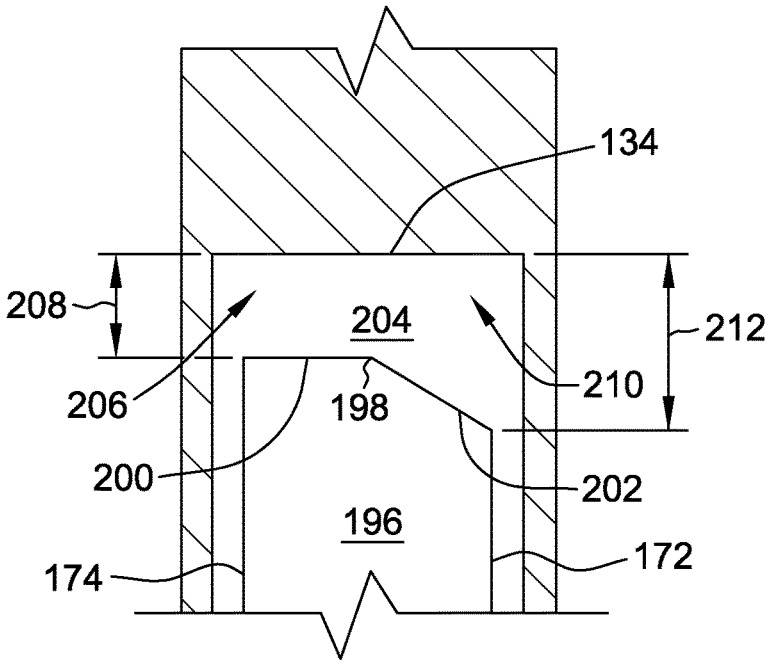
FIG. 6 is a side view of an alternative impeller blade tip.

FIG. 6 is a side view of an alternative impeller blade tip portion 196 that may be used with impeller 102 (shown in FIGS. 1-4). Tip portion 196 is substantially similar to tip portion 168 (shown in FIGS. 2-4), with the exception that tip portion 196 includes an at least partially linearly sloping trailing edge 198, rather than stepped trailing edge 160 (shown in FIGS. 2-4). As such, components shown in FIG. 5 are labeled with the same reference numbers used in FIGS. 1-4. Support ring 136 (shown in FIGS. 2-4) and sidewalls 114 and 122 (shown in FIGS. 1 and 4) are not shown for clarity. Tip portion 196 includes rear edge surface 172, front edge surface 174, and partially linearly sloping trailing edge 198. Trailing edge 198 includes a first portion 200 proximate front edge surface 174 and a second portion 202 proximate rear edge surface 172.

As shown in FIG. 6, first portion 200 is substantially parallel to cutoff point 134 and second portion 202 of trailing edge 198 is linearly slanted toward rear edge surface 172 such that a gap 204 is defined between trailing edge 198 and cutoff point 134. First portion 200 of trailing edge 198 and cutoff point 134 include complementary shapes such that a first portion 206 of gap 204 is defined therebetween, wherein first portion 206 includes a constant width 208. More specifically, first portion 200 and cutoff point 134 are substantially parallel to each other and to axis 120 (shown in FIGS. 1 and 4) to define first portion 206 having a constant width 208. Alternatively, first portion 200 and cutoff point 134 may both include complimentary curves or linear slopes that define first radial gap 206 having a constant width 208 therebetween. A second portion 210 of gap 204 is defined between linearly sloping second portion 202 of trailing edge 198 and cutoff point 134. Second trailing edge portion 202 slopes away from cutoff point 134 such that second gap portion 210 is gradually widening and defines a distance 212 at a point where second trailing edge portion 202 is furthest from cutoff point 134.

Figure 7:
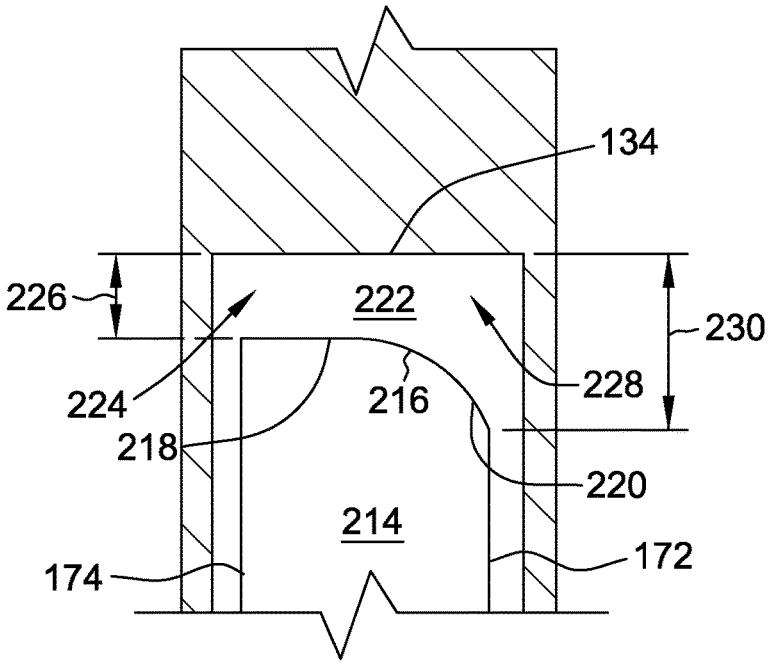
FIG. 7 is a side view of another alternative impeller blade tip.

FIG. 7 is a side view of another alternative impeller blade tip portion 214 that may be used with impeller 102 (shown in FIGS. 1-4). Tip portion 214 is substantially similar to tip portion 168 (shown in FIGS. 2-4) and tip portion 196 (shown in FIG. 5), with the exception that tip portion 214 includes an at least partially arcuate trailing edge 216, rather than stepped trailing edge 160 (shown in FIGS. 2-4). As such, components shown in FIG. 6 are labeled with the same reference numbers used in FIGS. 1-5. Support ring 136 (shown in FIGS. 2-4) and sidewalls 114 and 122 (shown in FIGS. 1 and 4) are not shown for clarity. Tip portion 214 includes rear edge surface 172, front edge surface 174, and an at least partially arcuate trailing edge 216. Trailing edge 216 is similar to trailing edges 160 and 198, and includes a first portion 218 proximate front edge surface 174 and a second portion 220 proximate rear edge surface 172.

As shown in FIG. 7, first portion 218 is substantially parallel to cutoff point 134 and second portion 220 of trailing edge 216 is arcuately sloped toward rear edge surface 172 such that a gap 222 is defined between trailing edge 216 and cutoff point 134. First portion 218 of trailing edge 216 and cutoff point 134 include complementary shapes such that a first portion 224 of gap 222 is defined therebetween, wherein first portion 224 includes a constant width 226. More specifically, first portion 218 and cutoff point 134 are substantially parallel to each other and to axis 120 (shown in FIGS. 1 and 4) to define first portion 224 having constant width 226. Alternatively, first portion 218 and cutoff point 134 may both include complimentary curves or linear slopes that define first radial gap 224 having a constant width 226 therebetween. A second portion 228 of gap 222 is defined between arcuately sloping second portion 220 of trailing edge 216 and cutoff point 134. Second trailing edge portion 220 slopes away from cutoff point 134 such that second gap portion 228 is gradually widening and defines a distance 230 at a point where second trailing edge portion 220 is furthest from cutoff point 134.

At least some known blower assemblies include continuously linear blade tip trailing edges that are parallel to the cutoff point across their entire widths. The blade tips are positioned nearby the cutoff point such that a gap having a constant width is defined therebetween. As described above, the performance of known blower assemblies increase as the size of the gap between the cutoff point and the blade tips decreases. However, when such continuously linear blade tips pass within close proximity to the cut-off point, they generate air pressure pulses that produce undesirable tonal noises known as blade pass pure tones.

Described herein are embodiments of impeller blades that include a non-linear trailing edge that maintains blower assembly performance, while also reducing blade pass tones. More specifically, a first portion of the trailing edge is parallel to the housing cutoff point such that a first gap having a constant distance is defined therebetween. Additionally, a second, larger, gap is defined between a second portion of the trailing edge and the cutoff point. The second portion of the trailing edge may be a linear notch positioned further from cutoff point 134 than the first trailing edge portion to define a constant width gap. Alternatively, the second portion may be a linear or an arcuate sloped edge that defines a widening gap between the cutoff point and the second portion. In any embodiment, as the blades pass by the cutoff point, the second portion of the trailing edge is positioned further away from the cutoff point than the first portion. The larger gap between the second trailing edge portion and the cutoff point facilitates reducing pressure pulses and undesirable noise caused by the trailing edge passing in close proximity to the cutoff point. The first portion of the trailing edge is spaced from the cutoff point by a smaller gap to facilitate maintaining a majority of the blower assembly performance specifications.

The embodiments described herein relate to a blower assembly including a noise attenuating impeller and methods for assembling the same. More specifically, the embodiments relate to a blower assembly that includes an impeller having a plurality of backward curved blades that each includes a tip portion that reduces the generation of tonal noises during operation of the blower assembly. More particularly, the embodiments relate to a tip portion of each blade having a trailing edge that defines a first gap between a cutoff point on the blower housing and a first portion of the trailing edge and a second gap between the cutoff point and a second portion of the trailing edge. The methods and apparatus are not limited to the specific embodiments described herein, but rather, components of apparatus and/or steps of the methods may be utilized independently and separately from other components and/or steps described herein. For example, the methods may also be used in combination with a forward curved fan or blower assembly, and are not limited to practice with only the backward curved fan as described herein. In addition, the exemplary embodiment can be implemented and utilized in connection with many other residential or commercial HVAC applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blower assembly comprising:

a housing comprising an outlet, an inlet, and a cutoff point positioned proximate said outlet; and an impeller comprising a rear plate and a plurality of blades coupled to said rear plate, wherein said rear plate positioned opposite said inlet, said plurality of blades each include a blade portion and a tip portion, wherein said blade portion comprises a first radial length and said tip portion comprises a second radial length shorter than said first radial length, said tip portion comprising a radially outer edge and a transition point that divides said radially outer edge into a first portion and a second portion, said impeller positioned within said housing such that a first radial gap is defined between said cutoff point and said first portion and a second radial gap is defined between said cutoff point and said second portion, wherein said first radial gap includes a constant width that is shorter than a width of said second radial gap, wherein said rear plate comprises a second radially outer edge positioned inward from said tip portion radially outer edge such that said tip portions extend entirely beyond said second radially outer edge.

2. The blower assembly in accordance with claim 1, wherein said first portion, said second portion, and said cutoff point are substantially parallel to each other.

3. The blower assembly in accordance with claim 1, wherein said second portion includes a notch such that said second radial gap defines a constant distance.

4. The blower assembly in accordance with claim 3, wherein said notch extends substantially halfway across said radially outer edge.

5. The blower assembly in accordance with claim 1, wherein said second portion is one of linearly slanted or arcuately sloped such that said second radial gap increases across said second portion.

6. The blower assembly in accordance with claim 1, wherein said first radial gap includes a constant width in a range of between about 0.125 in. and about 0.5 in.

7. The blower assembly in accordance with claim 1, wherein said housing further comprises at least one sidewall including an inlet opening.

8. The blower assembly in accordance with claim 7, wherein said impeller further comprises a support ring coupled to said tip portion of each blade, said support ring comprising a first face and an opposing second face, wherein a first axial gap is defined between said sidewall and said first face.

9. The blower assembly in accordance with claim 8, wherein said body portion is coupled radially inward from said tip portion, said body portion comprising an edge surface that is substantially coplanar with said second face such that a second axial gap is defined between said sidewall and said edge surface, wherein said second axial gap is larger than said first axial gap.

10. An impeller for use with a blower assembly that includes a cutoff point, said impeller comprising;

a rear plate including a first radially outer edge;

a plurality of blades coupled to said rear plate, said plurality of blades each include a blade portion and a tip portion, wherein said blade portion comprises a first radial length and said tip portion comprises a second radial length shorter than said first radial length, said tip portion comprising:

a radially inner edge and an opposing second radially outer edge, said second radially outer edge comprising a transition point that divides said second radially outer edge into a first portion and a second portion, wherein said first portion includes a shape that is complementary to at least a portion of a shape of the cutoff point;

a first edge face including a first axial length defined between said radially inner edge and said first portion; and a second edge face including a second axial length defined between said radially inner edge and said second portion, said first length being longer than said second length;

wherein said first radially outer edge positioned inward from said tip portion second radially outer edge such that said tip portions extend entirely beyond said first radially outer edge.

11. The impeller in accordance with claim 10, wherein said second portion is parallel to said first portion and a rotational axis, such that a first radial gap is defined between said first portion and the cutoff point and a second radial gap is defined between said second portion and the cutoff point, wherein said first radial gap includes a constant width that is shorter than a width of said second radial gap.

12. The impeller in accordance with claim 10, wherein said second portion is one of linearly slanted or arcuately sloped such that a first radial gap is defined between said first portion and the cutoff point and a second radial gap is defined between said second portion and the cutoff point, wherein said first radial gap is shorter than said second radial gap.

13. The impeller in accordance with claim 10, further comprising a support ring coupled to said tip portion of each blade, said support ring comprising a first face and an opposing second face.

14. The impeller in accordance with claim 13, wherein said body portion is coupled radially inward from said tip portion, said body portion comprising an edge surface that is substantially coplanar with said second face.

15. The impeller in accordance with claim 13, wherein said first edge face of each of said tip portions is coupled to said second face of said support ring.

16. A method of assembling a blower housing, said method comprising, providing a housing including an outlet, an inlet, and a cutoff point positioned proximate the outlet; and coupling an impeller within the housing, wherein the impeller includes a rear plate and a plurality of blades coupled to the rear plate, the plurality of blades each include a blade portion and a tip portion, wherein the blade portion includes a first radial length and the tip portion includes a second radial length shorter than the first radial length, the tip portion including a radially outer edge and a transition point that divides the radially outer edge into a first portion and a second portion, wherein the rear plate includes a second radially outer edge positioned inward from the tip portion radially outer edge such that the tip portions extend entirely beyond the second radially outer edge, wherein coupling the impeller within the housing comprises:

forming a first radial gap between the cutoff point and the first portion, wherein said first radial gap includes a constant width; and forming a second radial gap between the cutoff point and the second portion, wherein the second radial gap includes a width that is longer than said constant width of said first radial gap.

17. The method in accordance with claim 16, wherein forming a first radial gap further comprises forming the first radial gap having a constant width in a range of between about 0.125 in. and about 0.5 in.

18. The method in accordance with claim 16, wherein the housing includes a sidewall including an inlet opening, and wherein the impeller further includes a support ring coupled to the tip portion of each blade, the support ring including a first face and an opposing second face, and wherein coupling the impeller within the housing further comprises forming a first axial gap between the sidewall and the first face.

19. The method in accordance with claim 18, wherein the body portion is coupled radially inward from the tip portion, and wherein the body portion includes an edge surface that is substantially coplanar with the second face of the support ring, wherein coupling the impeller within the housing further comprises forming a second axial gap between the sidewall and the edge surface, wherein said second axial gap is larger than said first axial gap.

* * * * *